United States Patent [19]

Soykan

[11] 4,073,640

[45] Feb. 14, 1978

[54] METHOD OF MELTING SLAG

[75] Inventor: Ferhun H. Soykan, New Hartford, N.Y.

[73] Assignee: Special Metals Corporation, New Hartford, N.Y.

[21] Appl. No.: 775,827

[22] Filed: Mar. 9, 1977

[51] Int. Cl.[2] ..... C22B 4/00; C21C 5/52

[52] U.S. Cl. ..... 75/10 R; 75/11; 75/12

[58] Field of Search ..... 75/10–12

[56] References Cited

U.S. PATENT DOCUMENTS

| | | | |
|---|---|---|---|
| 3,234,608 | 2/1966 | Peras | 75/10 |
| 3,276,859 | 10/1966 | Collin | 75/11 |

*Primary Examiner*—Peter D. Rosenberg

*Attorney, Agent, or Firm*—Vincent G. Gioia; Robert F. Dropkin

[57] ABSTRACT

Slag which is not electrically conductive when solid or at least at temperatures below 1500° F. is melted by providing a graphite covering on top of the solid slag, contacting the covering material with at least two electrodes in spaced apart relationship, and supplying electric power to the electrodes to cause the graphite to sublime and set a plasma arc of carbon dioxide between the electrodes with resulting initial melting of the slag adjacent the electrodes. This melted slag then provides a conductive electrical path between the electrodes for continued melting of the slag.

6 Claims, 1 Drawing Figure

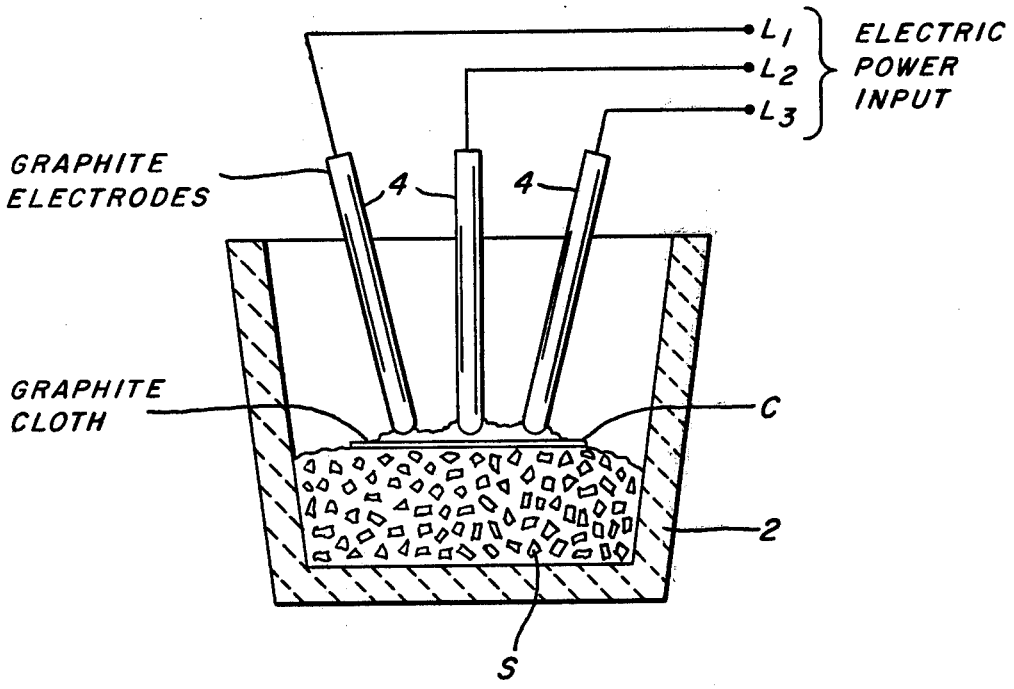
L1
L2
L3
ELECTRIC POWER INPUT
GRAPHITE ELECTRODES
4
4
GRAPHITE CLOTH
C
2
S

METHOD OF MELTING SLAG

This invention relates to a method of melting slag and more particularly to starting the melting of solid non-conductive slag or flux which is used between the consumable electrode and the ingot in the Electro Slag Refining Process (ESR). This process is used to produce many types of high temperature alloys with the particular slag used varying according to the alloy to be produced. Generally the slag includes aluminum oxides, calcium oxides, and/or calcium fluorides in various percentages. These slags are generally melted in a Graphite Electrode Arc Furnace prior to being charged into the Electro Slag Refining Furnace. It is very difficult and sometimes impossible to start a Graphite Electrode Arc Furnace to melt the slag since solid slag does not conduct electricity at least until it reaches high temperatures such as 1500° to 2000° F. When melted it will conduct electricity. Various methods have been used to promote starting. To my knowledge the most commonly used method is to place a bunch of steel wool, aluminum foil or similar substance on top of the solid slag. These do not provide a reliable start because they have a relatively low melting point and the slag will not melt rapidly. In addition, they may, and often do, contaminate the slag.

I have found that a reliable start of the melting process can be obtained by covering the charge with a relatively pure material which sublimes without melting. It is necessary that the covering provide a good electrical path between electrodes. As the material is heated it sublimes and produces a gas which sets a plasma arc between the electrodes. This produces a temperature which may be as high as 4500° to 5000° F which will melt the slag around the electrodes immediately so that there will rapidly be a conductive molten slag path between electrodes.

It is therefore an object of my invention to provide a method of melting slag (non-conductive when solid, but conductive when molten) in an electric arc furnace which is more efficient than prior methods.

Another object is to provide such a method which provides a slag relatively free of contaminants.

These and other objects will be more apparent after referring to the following specification and attached drawings in which:

The single FIGURE is a schematic view of apparatus used in carrying out my invention.

Referring more particularly to the drawing, reference numeral 2 indicates a graphite crucible for containing slag S to be melted. Graphite electrodes 4 are positioned in the crucible 2 and are supplied with power from source L1, L2, L3. While three electrodes are shown and are commonly used it will be understood that only two are necessary. The power supply may vary, but is commonly 100 volts open circuit A.C. between 1000 and 2000 amperes. The charge generally is between 100 and 1000 pounds. The crucible 2 commonly has a diameter between 24 and 26 inches and a height between 18 and 24 inches. The apparatus so far described is conventional. According to my invention, I provide a covering C on top of the slag S. The covering C need not cover the entire surface of the slag, but it is necessary that it extend between the electrodes 4 so as to provide a substantially continuous electrical conductive path therebetween. For that reason it must be sheet-like. The material of the covering C must be electrically conductive and must sublime without melting. It should be relatively pure so as to contain no material which would contaminate the slag. I have found that graphite cloth or graphite flexible sheets are particularly suitable. A sheet as little as 1/32 inch thick may be used. I have also used two layers of graphite cloth with each layer being between 1/32 and 1/16 in. thick. It is preferred not to exceed a total thickness of ⅛ inch because no advantage is obtained with more material and it is possible that some contamination may result.

My method is carried out as follows: The crucible 2 is charged with solid slag S of the usual type in the usual manner. The slag is particulate or granular with the size of the particles not being critical. The covering C is then placed on the slag S, the bottoms of electrodes 4 are positioned in contact with the covering, and the power is turned on with current flowing through the covering C between the electrodes 4. The high intensity current quickly increases the temperature of the graphite cloth to a level at which the graphite rapidly sublimes and forms carbon dioxide. This sets a plasma arc between the electrodes with a resultant plasma arc temperature between 4000° and 5000° F which is sufficient to melt the slag around the electrodes immediately. Since the molten slag is electrically conductive, the process is then continued in the convention manner with current passing between the electrodes through a molten slag pool which grows bigger and bigger until all or practically all of the solid slag is melted. The melted slag is then poured between the electrode and stool of an ESR furnace to start the refining process.

While one embodiment has been shown and described, it will be readily apparent to those skilled in the art that various adaptations and modifications may be made within the scope of the invention.

I claim:

1. The method of melting slag which is not electrically conductive at ambient temperatures which comprises charging a crucible with solid slag, placing on top of said charge a sheet-like covering of an electrically conductive material which sublimes without melting, contacting said covering material with at least two electrodes in spaced apart relationship with the covering providing a good electrical path between electrodes, supplying electric power to said electrodes to cause said covering material to sublime and set a plasma arc between said electrodes to start melting of the scrap, and continuing application of said electric power after initial melting of the slag with current passing through the slag between electrodes to melt said slag in said crucible.

2. The method of slag according to claim 1 in which said covering material is carbon.

3. The method of slag according to claim 1 in which said covering is a graphite cloth.

4. The method of slag according to claim 3 in which said graphite cloth extends between electrodes.

5. The method of slag according to claim 1 in which said covering is a maximum of ⅛ inch thick.

6. The method of melting slag which is not electrically conductive at ambient temperatures which comprises charging a graphite crucible with said slag in a granular form, placing at least one graphite cloth on top of said slag in said crucible, contacting said graphite cloth with at least two graphite electrodes in spaced apart relationship, supplying electric power to said electrodes to cause said graphite cloth to sublime to start melting of the scrap, and continuing application of said electric power after initial melting of the slag with current passing through the slag between electrodes to melt said slag in said crucible.

* * * * *